US009341986B2

(12) United States Patent
Nakamoto et al.

(10) Patent No.: US 9,341,986 B2
(45) Date of Patent: May 17, 2016

(54) DEVELOPING DEVICE, IMAGE FORMING APPARATUS, AND PROCESS CARTRIDGE

(71) Applicants: Atsushi Nakamoto, Kanagawa (JP); Tadashi Ogawa, Tokyo (JP); Koichi Yamazaki, Kanagawa (JP); Hironori Ohshima, Kanagawa (JP)

(72) Inventors: Atsushi Nakamoto, Kanagawa (JP); Tadashi Ogawa, Tokyo (JP); Koichi Yamazaki, Kanagawa (JP); Hironori Ohshima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/328,876

(22) Filed: Jul. 11, 2014

(65) Prior Publication Data

US 2015/0023700 A1 Jan. 22, 2015

(30) Foreign Application Priority Data

Jul. 18, 2013 (JP) ..... 2013-149604

(51) Int. Cl.
*G03G 15/09* (2006.01)
*G03G 21/18* (2006.01)

(52) U.S. Cl.
CPC ..... *G03G 15/0921* (2013.01); *G03G 15/09* (2013.01); *G03G 21/18* (2013.01)

(58) Field of Classification Search
USPC ..... 399/272
See application file for complete search history.

(56) References Cited

U.S. PATENT DOCUMENTS 8,346,134 B2 * 1/2013 Nakayama ..... G03G 15/0808 399/254
2008/0247786 A1 10/2008 Nakayama et al.
2009/0197192 A1 * 8/2009 Hiroko et al. ..... 430/106.2
2011/0129262 A1 6/2011 Nakamoto
2011/0217085 A1 9/2011 Hattori et al.
2012/0051797 A1 * 3/2012 Suzuki ..... G03G 15/081 399/272
2012/0057904 A1 * 3/2012 Maehara ..... G03G 15/0808 399/254
2012/0163872 A1 * 6/2012 Hayashi et al. ..... 399/254
2012/0163874 A1 6/2012 Hattori et al.
2012/0219326 A1 8/2012 Koike et al.
2012/0321346 A1 * 12/2012 Fukamachi ..... G03G 15/0896 399/119
2013/0034368 A1 2/2013 Hattori et al.
2013/0084108 A1 * 4/2013 Suzuki et al. ..... 399/274
2013/0136464 A1 * 5/2013 Okada ..... G03G 15/0824 399/27
2014/0003843 A1 1/2014 Yuji SUZUKI et al.

FOREIGN PATENT DOCUMENTS

JP 2008-256813 10/2008
JP 2012-108466 6/2012

* cited by examiner

*Primary Examiner* — Clayton E Laballe
*Assistant Examiner* — Linda B Smith
(74) *Attorney, Agent, or Firm* — Oblon, McClelland, Maier & Neustadt, L.L.P.

(57) ABSTRACT

A drawing-up magnetic pole and a control magnetic pole of a magnetic field generator that is disposed in a developer carrier are adjacent to each other and a prevention member is provided that secures, between the prevention member and an upper end of a side wall of a developer supply conveyance path, a supply path through which a developer in the developer supply conveyance path passes toward the developer carrier at least over the entire width of a developing area and that prevents a control retained developer, which is prevented by a developer control member from passing through a control gap, from moving toward the surface of the developer carrier along lines of the control magnetic force. The peak of the magnetic flux density of the drawing-up magnetic pole in the normal direction is disposed below the lower end of the supply path.

18 Claims, 6 Drawing Sheets

DEVELOPING DEVICE, IMAGE FORMING APPARATUS, AND PROCESS CARTRIDGE

CROSS-REFERENCE TO RELATED APPLICATIONS

The present application claims priority to and incorporates by reference the entire contents of Japanese Patent Application No. 2013-149604 filed in Japan on Jul. 18, 2013.

BACKGROUND OF THE INVENTION

1. Field of the Invention

The present invention relates to a developing device, an image forming apparatus, and a process cartridge.

2. Description of the Related Art

For image forming apparatuses, such as an electrophotographic copier, electrostatic recording apparatus, and magnetic recording apparatus, image forming apparatuses are known each including a developing device employing a two-component developing system that performs a process for developing an electrostatic latent image formed on a latent image carrier with a two-component developer (the "developer" below). In this developing process, the developer is conveyed while being magnetically carried on the surface of a developer carrier that is rotatably attached to a developing device housing, etc. and, in a developing area where the developer carrier and a latent image carrier are opposed to each other, a magnetic force acts on the developer so that carrier chains are caused. The magnetic brush that is formed due to the carrier chains is rubbed against the surface of the latent image carrier to attach the toner onto the electrostatic latent image on the surface of the latent image carrier so that the electrostatic latent image is made visible. Such a developing process generally requires a magnetic field generator, such as a magnet, including plural magnetic poles disposed in the developing carrier. An exemplary magnetic pole of the magnetic field generator is a drawing-up magnetic pole that causes a magnetic force for drawing up the developer onto the developer carrier is. Another exemplary magnetic pole of the magnetic field generator is a control magnetic pole for generating a control magnetic force for causing carrier chains in the developer when the developer passes through a control gap where the developer carried on the surface of the developer carrier passes through and accordingly the amount of the developer to be conveyed to the developing area is controlled. Still another exemplary magnetic pole of the magnetic field generator is a developing magnetic pole that generates a developing magnetic force for causing carrier chains in the developer on the developer carrier in the developing area.

Such a developing device employing the two-component developer system is disclosed in, for example, Japanese Laid-open Patent Publication No. 2012-108466. The developing device circulates and conveys a developer in the developing device along a developer circulation path that includes a developer supply conveyance path in which the developer supplied onto the surface of a developer carrier is conveyed, with a developer supply conveyance member, along the direction of the rotation axis of the developer carrier. The developer supply conveyance path is disposed as adjacent to the surface of the developer carrier and, due to the effect of a drawing-up magnetic force, the developer being conveyed is attracted over the upper end of a side wall on the side of the developer carrier in the developer supply conveyance path toward the surface of the developer carrier so that the developer is carried on the surface of the developer carrier. The developer thus carried on the developer carrier in this manner is conveyed in the developer-carrier-surface moving direction in accordance with the rotation of the developer carrier and passes through the control gap where the surface of the developer carrier and the developer control member are opposed to each other. When the developer passes through the control gap, the developer carried with a small distance to the surface of the developer carrier can pass through the control gap, but on the other hand, the developer carried with a large distance to the surface of the developer carrier is prevented by the developer control member from passing through the control gap. In the developing device, the developer passes through the control gap and accordingly a constant amount of the developer is conveyed to the developing area. The developer that is prevented by the developer control member from passing through the control gap returns to the developer supply conveyance path, is collected in the developer supply conveyance path, and is drawn up again onto the developer carrier.

In the developing device according to Japanese Laid-open Patent Publication No. 2012-108466, the drawing-up magnetic pole and the control magnetic pole are adjacent to each other in the developer-carrier-surface moving direction and have opposite polarities. Furthermore, a prevention member is provided that keeps, between the prevention member and the upper end of the side wall in the developer supply conveyance path, a supply path through which the developer in the developer supply conveyance path passes toward the developer carrier at least over an entire area along the direction of the rotation axis of the developer carrier in the developing area and that prevents the developer, which is prevented by the developer control member from passing through the control gap, from moving toward the surface of the developer carrier along lines of the control magnetic force.

Developing devices employing the two-component developer system are each provided with a control magnetic pole because of the following reason: when the properties of the developer, such as fluidity, change due to time degradation of the developer and environmental change, the amount of developer to pass through the control gap varies so that a constant amount of the developer cannot be conveyed to the developing area, which may lead to a risk of causing an inconvenience that developing capability cannot be maintained steadily. It is known that such an inconvenience can be reduced by providing a control magnetic pole that generates a control magnetic force such that the control magnetic force acts on the developer passing through the control gap so as cause carrier chains. For this reason, the developing device according to Japanese Laid-open Patent Publication No. 2012-108466 includes the control magnetic pole for generating a control magnetic force for causing carrier chains in the developer passing through the control gap.

However, as described below, just provision of the control magnetic pole does not hinder image density unevenness so that image quality degradation is caused. In order to solve this, the prevention member is provided that secures the supply path between the prevention member and the upper end of the side wall in the developer supply conveyance path and that prevents the developer, which is prevented from passing through the control gap by the developer control member, from moving toward the surface of the developer carrier along the lines of the control magnetic force.

When the control magnetic pole is disposed, the control magnetic force acts on the developer that is prevented from passing through the control gap, which leads to a situation that the developer is retained in the downstream space with respect to the developer control member in the developer-carrier-surface moving direction (hereinafter, the "control retaining space"). The developer retained in the control retaining space (hereinafter, the "control retained developer") is retained in the control retaining space while rotating (circulating) in the opposite direction to the rotation direction of the developer carrier in the control retaining space as the surface of the developer carrier moves. While the control retained developer circulates in the control retaining space with the binding force of the control magnetic force, triboelectric charging of the control retained developer progresses so that the amount of toner charge becomes higher than that of the different developer circulated and conveyed in the developing device. This causes a difference in developing capability (the amount of toner to be attached to the electrostatic latent image per unit area when the image is developed) between the control retained developer and the developer other than the control retained developer. Even if such a developer with difference in developing capability is used for developing, image density unevenness that can be recognized by human is not caused as long as the developers are mixed and dispersed uniformly. However, if the developer not sufficiently mixed is used for developing, image density unevenness that can be recognized by human is caused, which causes image quality degradation. In other words, there is a problem in that the control retained developer with a very large amount of toner charge that is not sufficiently mixed with the developer other than the control retained developer is used for developing and accordingly image density unevenness is caused, which causes image quality degradation.

This aspect will be described here more in detail. The control retained developer that escapes the binding by the control magnetic force while circulating is sequentially collected into the developer supply conveyance path. Once being collected into the developer supply conveyance path, the control retained developer is sufficiently mixed with the developer other than the control retained developer and then is drawn up again so that the above-described image quality degradation is not caused. However, when the drawing-up magnetic pole with a polarity opposite to that of the control magnetic pole is disposed adjacent to the control magnetic pole on the upstream side with respect to the control magnetic pole in the developer-carrier-surface moving direction, a magnetic field is formed where the magnetic force lines connecting the control magnetic pole and the drawing-up magnetic pole pass through the control retaining space where the control retained developer is retained. In such a magnetic field, a part of the control retained developer, more particularly, a part of the control retained developer most close to the drawing-up magnetic pole moves toward the drawing-up magnetic pole along the magnetic force lines and is attracted to the surface of the developer carrier. As a result, the control retained developer is carried on the surface of the developer carrier with a part of the control retained developer kept not collected into the developer supply conveyance path.

Here, because the developer from the developer supply conveyance path has been already drawn up to the surface of the developer carrier, in a spot where a sufficient amount of the developer has been drawn up, the control retained developer attracted by the drawing-up magnetic force is carried on the surface of the developer carrier as overlapping the developer from the developer supply conveyance path. Here, because the control retained developer is carried on an area distant from the surface of the developer carrier, the control retained developer cannot pass thorough the control gap due to the developer control member and thus is not transferred to the developing area and retained in the control retaining space again. For this reason, image concentration unevenness is not caused and thus image quality degradation is not caused.

The control retained developer that is attracted by the drawing-up magnetic force, however, may hinder the drawing-up of the developer from the developer supply conveyance path, which causes a spot where the amount of the developer to be drawn up from the developer supply conveyance path is locally insufficient. Particularly, with the configuration where a conveyance screw in which a blade is provided as being like a screw on the rotation axis conveys the developer in the developer supply conveyance path in the rotation axis direction, the force for sending out the developer toward the developer carrier with the blade is not uniform in the rotation axis direction. Thus, in a spot where the force for sending out the developer toward the developer carrier is weak, the control retained developer attracted by the drawing-up magnetic force hinders the drawing up of the developer from the developer supply conveyance path, which results in an insufficient amount of the developer from the developer supply conveyance path. In the spot where the amount of the developer to be drawn up from the developer supply conveyance path is locally insufficient, the control retained developer attracted by the drawing-up magnetic force is carried in an area close to the surface of the developer carrier, so that the control retained developer passes through the control gap and is conveyed to the developing area. As a result, a developer layer in which the control retained developer with an abnormally large amount of toner charge and the developer, other than the control retained developer, with a normal amount of toner charge are not sufficiently mixed with each other is sent to the developing area, which causes image density unevenness so that image quality degradation is caused.

In the developing device according to Japanese Laid-open Patent Publication No. 2012-108466, provision of the prevention member prevents the control retained developer attracted by the drawing-up magnetic force from moving toward the surface of the developer carrier along the lines of the control magnetic force. Thus, the control retained developer attracted by the drawing-up magnetic force does not hinder the drawing up of the developer from the developer supply conveyance path. Accordingly, a spot where the amount of the developer to be drawn up from the developer supply conveyance path is locally insufficient tends not to be caused and the control retained developer attracted by the drawing-up magnetic force tends not to be carried in an area close to the surface of the developer carrier where the developer possibly passes through the control gap. This reduces occurrence of a situation where a developer layer in which the control retained developer with an abnormally large amount of toner charge and the developer, other than the control retained developer, with a normal amount of toner charge are not sufficiently mixed with each other is sent to the developing area, which reduces image quality degradation due to image density unevenness. Because a supply path is kept between the prevention member and the upper end of the side wall in the developer supply conveyance path, provision of the prevention member does not hinder the operation of drawing up the developer in the developer supply conveyance path to the surface of the developer carrier.

In the developing device according to Japanese Laid-open Patent Publication No. 2012-108466, however, a drawing-up magnetic pole S2 is disposed such that the magnetic flux density peak of the drawing-up magnetic pole S2 in the normal direction is opposed to an upper part of the supply path. The drawing-up magnetic force generated by the drawing-up magnetic pole S2 causes the developer conveyed by the developer supply conveyance member in the developer supply conveyance route to pass through the supply path and to be attracted toward the developer carrier and drawn up. With this configuration, the drawing-up magnetic force is weak below the lower end of the supply path. Thus, if the amount of the developer near the developer supply conveyance member in the developer supply conveyance path is small or if the developer supply conveyance member has low capability for conveying the developer in its rotation direction, the amount of the developer to be supplied from the developer supply conveyance path to the developer carrier via the supply path is reduced. When the amount of the developer to be supplied to the developer carrier via the supply path is insufficient, a developer layer in which the control retained developer and the develop, other than the control retained developer, with a normal amount of toner charge are not sufficiently mixed with each other is conveyed to the developing area, which causes image quality degradation due to image density unevenness.

Therefore, it is desirable to provide a developing device that reduces occurrence of a situation where a developer layer in which the control retained developer and the developer, other than the control retained developer, drawn up from the developer supply conveyance route are not sufficiently mixed with each other is sent to the developing area, which reduces image quality degradation due to image density unevenness and to provide an image forming apparatus that includes the developing device.

SUMMARY OF THE INVENTION

It is an object of the present invention to at least partially solve the problems in the conventional technology.

According to an aspect of the present invention, there is provided a developing device including: a developer carrier that includes a magnetic field generator housed in the developer carrier, and that rotates, with a developer containing toner and magnetic carriers and carried on a surface of the developer carrier with a magnetic force that is generated by the magnetic field generator, so as to convey the developer to a developing area where the developer is opposed to the surface of a latent image carrier; a developer control member that forms, between the developer control member and the surface of the developer carrier, a control gap through which the developer carried on the surface of the developer carrier passes and accordingly the amount of the developer to be conveyed to the developing area is controlled; and a developer supply conveyance path that is disposed adjacent to the surface of the developer carrier, in which the developer to be supplied onto the surface of the developer carrier is conveyed with a developer supply conveyance member along a direction of a rotation axis of the developer carrier, and into which the developer that is prevented by the developer control member from passing through the control gap is collected, wherein the magnetic field generator includes at least: a drawing-up magnetic pole that generates a drawing-up magnetic force for attracting the developer in the developer supply conveyance path toward the developer carrier over an upper end of a side wall on a side of the developer carrier in the developer supply conveyance path and for drawing up the developer to the surface of the developer carrier; and a control magnetic pole that generates a control magnetic force for causing carrier chains in the developer that is passing through the control gap, the drawing-up magnetic pole and the control magnetic pole are adjacent to each other in the direction in which the surface of the developer carrier moves and have polarities opposite to each other, a prevention member is provided that secures, between the prevention member and the upper end of the side wall, a supply path through which the developer in the developer supply conveyance path passes toward the developer carrier at least over an entire area along the direction of the rotation axis of the developer carrier in the developing area and that prevents the developer, which is prevented by the developer control member from passing through the control gap, from moving toward the surface of the developer carrier along lines of the control magnetic force, and the peak of magnetic flux density of the drawing-up magnetic pole in the normal direction is disposed below the lower end of the supply path.

According to another aspect of the present invention, there is provided a developing device including: a developer carrier that includes a magnetic field generator housed in the developer carrier, and that rotates, with a developer containing toner and magnetic carriers and carried on a surface of the developer carrier with a magnetic force that is generated by the magnetic field generator, so as to convey the developer to a developing area where the developer is opposed to the surface of a latent image carrier; a developer control member that forms, between the developer control member and the surface of the developer carrier, a control gap through which the developer carried on the surface of the developer carrier passes and accordingly the amount of the developer to be conveyed to the developing area is controlled; and a developer supply conveyance path that is disposed adjacent to the surface of the developer carrier, in which the developer to be supplied onto the surface of the developer carrier is conveyed with a developer supply conveyance member along a direction of a rotation axis of the developer carrier, and into which the developer that is prevented by the developer control member from passing through the control gap is collected, wherein the magnetic field generator includes at least: a drawing-up magnetic pole that generates a drawing-up magnetic force for attracting the developer in the developer supply conveyance path toward the developer carrier over an upper end of a side wall on a side of the developer carrier in the developer supply conveyance path and for drawing up the developer to the surface of the developer carrier; and a control magnetic pole that generates a control magnetic force for causing carrier chains in the developer that is passing through the control gap, the drawing-up magnetic pole and the control magnetic pole are adjacent to each other in the direction in which the surface of the developer carrier moves and have polarities opposite to each other, a prevention member is provided that secures, between the prevention member and the upper end of the side wall, a supply path through which the developer in the developer supply conveyance path passes toward the developer carrier at least over an entire area along the direction of the rotation axis of the developer carrier in the developing area and that prevents the developer, which is prevented by the developer control member from passing through the control gap, from moving toward the surface of the developer carrier along lines of the control magnetic force, and a total magnetic flux density of the drawing-up magnetic pole in the normal direction in an area surrounded by a line connecting the center of rotation of the developer carrier and the lower end of the supply path and a tangent connecting the center of rotation of the developer carrier and the circumference of the developer supply conveyance member below the supply path on the surface of the developer carrier is equal to or larger than 700 mT·deg.

The above and other objects, features, advantages and technical and industrial significance of this invention will be better understood by reading the following detailed description of presently preferred embodiments of the invention, when considered in connection with the accompanying drawings

DETAILED DESCRIPTION OF THE PREFERRED EMBODIMENTS

Embodiments of an imaging device, an image reading device, an image forming apparatus, and a method of driving an imaging device will be described in detail below with reference to the accompanying drawings.

First Embodiment

An embodiment (hereinafter, "first embodiment") of an electrophotographic color laser printer (hereinafter, the "printer") will be described as an image forming apparatus to which the present invention is applied.

Figure 1:
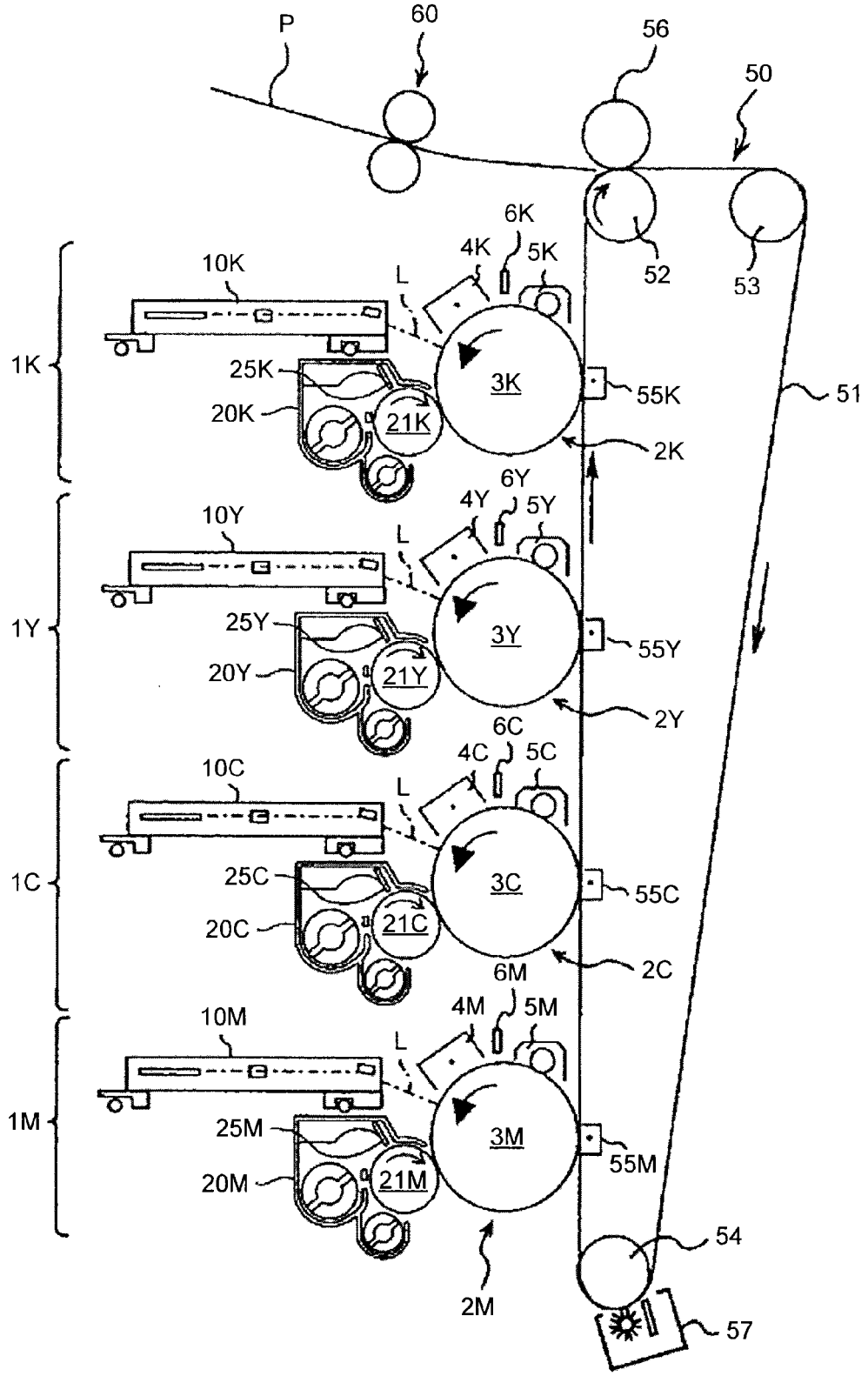
FIG. 1 is a schematic configuration diagram of main units of a printer according to a first embodiment.

FIG. 1 is a schematic configuration diagram of main units of the printer according to the first embodiment.

The printer includes four toner image forming units 1M, 1C, 1Y and 1K for forming toner images of each color: magenta, cyan, yellow and black (hereinafter, "M, C, Y and K"). The printer further includes a transfer unit 50 on a lateral side with respect to the toner image forming units 1M, 1C, 1Y and 1K that are vertically arranged.

The toner image forming units 1M, 1C, 1Y and 1K have almost the same configuration except that each image forming unit uses a different toner color. A toner image forming unit 1M for M for forming an M toner image will be described here. The toner image forming unit 1M includes a processing unit 2M, an optical writing unit 10M, and a developing unit 20M.

The processing unit 2M for M includes a drum-shaped photosensitive element 3M that is driven to rotate counterclockwise as illustrated in FIG. 1. The processing unit 2M includes a uniform charging device 4M, a drum cleaning device 5M, and an anti-static lamp 6M around the photosensitive element 3M that are held in a common casing such that they can be integrally attached to or detached from the printer main unit. The photosensitive element 3M serving as a latent image carrier is formed by covering an organic photosensitive layer on a pipe made of, for example, aluminum.

The uniform charging device 4M negatively and uniformly charges by corona charging the surface of the photosensitive element 3M that is driven to rotate counterclockwise as illustrated in FIG. 1.

The optical writing unit 10M includes a light source consisting of a laser diode etc., a polygon mirror in the form of a polyhedron, a polygon motor that drives the polygon mirror to rotate, an fθ lens, a lens, a reflective mirror. A laser light L that is emitted from the light source that is driven according to image information that is transmitted from, for example, a personal computer (not shown) is reflected on a plane of the polygon mirror and, while being deflected in accordance with the rotation of the polygon mirror, reaches the photosensitive element 3M. Accordingly, the surface of the photosensitive elements 3M is optically scanned and an electrostatic latent image for M is formed on the surface of the photosensitive element 3M.

The developing unit 20M for M that is a developing device includes a developing roller 21M with its circumferential surface partly exposed via an opening that is provided to the casing. The developing roller 21M includes a developing sleeve that serves as a developer carrier, that is formed of a non-magnetic pipe, and that is driven to rotate by a drive unit (not shown) and a magnet roller that serves as a magnetic field generator (not shown) and that is housed in the developing roller 21M so as not to be rotated in accordance with the rotation of the developing sleeve. The developing unit 20M houses an M developer (not shown) that contains magnetic carriers and negatively-charged M toner. While the M developer is stirred and conveyed by three conveyance screws, which will be described below, and thus triboelectric charging of the M toner is promoted, the magnetic force of the magnet roller in the developing roller 21M causes the M developer to be adsorbed and drawn up onto the surface of the rotating developing sleeve of the developing roller 21M. After the thickness of the M developer is controlled when the M developer passes through a position opposed to a doctor blade 25M in accordance with the rotation of the developing sleeve, the M developer is conveyed to a developing position where the M developer is opposed to the photosensitive element 3M.

In the developing position, a developing potential that causes the negative M toner to electrostatically move from the developing sleeve toward the latent image acts between the developing sleeve to which a negative developing bias that is output from a power supply (not shown) is applied and the electrostatic latent image on the photosensitive element 3M. Furthermore, a non-developing potential that causes the negative M toner to move electrostatically from a uniformly charged spot (ground spot) on the photosensitive element 3M toward the developing sleeve acts between the developing sleeve and the ground spot. The effect of the developing potential causes the M toner in the M developer on the developing sleeve to be transferred onto the electrostatic latent image on the photosensitive element 3M. This transfer develops the electrostatic latent image on the photosensitive element 3M into an M toner image. The M developer where the M toner is consumed for the developing is returned into the casing in accordance with the rotation of the developing sleeve. The M toner image on the photosensitive element 3M is transferred onto an intermediate transfer belt 51 of the transfer unit 50, which will be described below.

The developing unit 20M includes a toner density sensor (not shown) consisting of a permeability sensor. The permeability sensor outputs a voltage of a value corresponding to the permeability of the M developer stored in the developer collection conveyance path of the developing unit 20M, which will be described below. Because the permeability of the developer shows a preferable correlation with the toner density of the developer, the toner density sensor outputs a voltage of a value corresponding to the toner density. The value of the output voltage is transmitted to a toner supply controller (not shown). The toner supply controller includes a memory unit, such as a RAM, that stores Vtref for M that is a target value of the output voltage from the toner density sensor for M and Vtref data for C, Y and M that is a target value of the output voltage from the toner density sensor that is mounted on a different developing unit. For the developing unit 20M for M, the value of the output voltage of the toner density sensor for M is compared with Vtref for M and the M toner concentration supply device (not shown) is driven for a period of time corresponding to the result of the comparison. In this manner, the M toner is supplied to the developer collection conveyance path in the developing unit 20M. Driving of the M toner supply device is controlled (toner supply control) as described above so that an appropriate amount of M toner is supplied to the M developer where the M toner density is lowered due to the developing and thus the M toner density with respect to the M developer in the developing unit 20M is maintained within a predetermined range. The same toner supply control is performed on the developing units 20C, 20Y and 20M.

The M toner image developed on the photosensitive element 3M is transferred to the front surface of the intermediate transfer belt 51, which will be described below. Transfer residual toner that has not been transferred onto the intermediate transfer belt 51 is attached to the surface of the photosensitive element 3M that has undergone the transfer processing. The transfer residual toner is removed by a drum cleaning device 5K. After the static electricity on the surface of the photosensitive element 3M, from which the transfer residual toner is removed as described above, is eliminated with the anti-static lamp 6M, the surface of the photosensitive element 3M is uniformly charged by the uniform charging device 4M again.

Although FIG. 1 does not illustrate, the processing unit 2M and the developing unit 20M of the toner image forming unit 1M may be held in a common casing integrally in a form of a process cartridge such that they may be integrally attached to or detached from the printer main unit.

The toner image forming unit 1M for M has been described. Through the same process, C, Y and K toner images are formed on the surfaces of the photosensitive elements 3C, 3Y and 3K in the toner image forming units 1C, 1Y and 1K for other colors.

The transfer unit 50 is disposed on the right side with respect to the toner image forming units 1M, 1C, 1Y and 1K that are disposed as arrayed vertically. The transfer unit 50 includes a drive roller 52, a tension roller 53, and a driven roller 54 within the loop of the endless intermediate transfer belt 51. While being kept tensioned with these three rollers, the endless intermediate transfer belt 51 is driven to rotate clockwise as illustrated in FIG. 1 by the drive roller 52. The tensioned front surface of the endless intermediate transfer belt 51, which is moved as described above, on the left side in FIG. 1, makes contact with the photosensitive elements 3M, 3C, 3Y and 3K for M, C, Y and K so that primary transfer nips for M, C, Y and K are formed.

Within the loop of the intermediate transfer belt 51, four transfer chargers 55M, 55C, 55Y and 55K are disposed in addition to the above-described three rollers. These transfer chargers 55M, 55C, 55Y and 55K are disposed so as to charge the back surface of the intermediate transfer belt 51 on the back of the primary transfer nips for M, C, Y and K. The charging forms, in each of the primary transfer nips for M, C, Y and K, a transfer electric field with an orientation for moving the toner electrostatically from the photosensitive elements 3M, 3C, 3Y and 3K to the front side of the belt. Instead of the corona charging transfer charger, a transfer roller to which a transfer bias is applied may be used.

The M, C, Y and K toner images that are formed on the photosensitive elements 3M, 3C, 3Y and 3K of the respective colors move onto the front surface of the belt from the photosensitive belt due to the effect of the nip pressure and the transfer electric field in the primary transfer nips of the respective colors and are transferred as superimposed onto the intermediate transfer belt 51. Accordingly, a toner image of four superimposed images (hereinafter, the "four-color toner image") is formed on the intermediate transfer belt 51.

A secondary transfer bias roller 56 makes contact with the front surface of the intermediate transfer belt 51 in a spot where the intermediate transfer belt 51 overlays on the drive roller 52 so that a secondary nip is formed. The secondary transfer bias roller 56 is applied with a secondary transfer bias by a voltage application unit consisting of a power supply and interconnects (not shown). Accordingly, a secondary transfer electric field is formed between the secondary transfer bias roller 56 and the grounded drive roller 52. The four-color toner image formed on the intermediate transfer belt 51 enters the secondary transfer nip in accordance with the movement of the endless belt.

The printer includes a paper feeding cassette (not shown) where plural sheets of recording paper P are stored in a form of a recording paper bundle. The top sheet of recording paper P is sent out to a paper feeding path at a given timing. The sent sheet of recording paper P is interposed between a pair of registration rollers 60 that is disposed at the end of the paper feeding path.

Both of the registration rollers 60 are driven to rotate so as to interpose the sheet of recording paper P, which is sent from the paper feeding cassette, between the registration rollers 60 and, once the end of the sheet of recording paper P is interposed between the rollers, rotating the rollers is stopped. The sheet of recording paper P is then sent out toward the secondary transfer nip at a timing such that the sheet of recording paper P is synchronized with the four-color toner image on the intermediate transfer belt 51. In the secondary transfer nip, the four-color toner image on the intermediate transfer belt 51 is secondarily transferred onto the sheet of recording paper P by the effect of the secondary transfer electric filed and the nip pressure, which leads to a full-color image in combination with white of the sheet of recording paper P. After the sheet of recording paper P on which the full-color image is formed in this manner is ejected from the secondary transfer nip, the full-color image is sent to a fixing device (not shown) and the full-color image is fixed.

The secondary transfer residual toner attached to the surface of the intermediate transfer belt, which has passed through the secondary transfer nip, is removed from the surface of the belt by a belt cleaning device 57 with the intermediate transfer belt 51 interposed between the belt cleaning device 57 and the driven roller 54.

Figure 2:
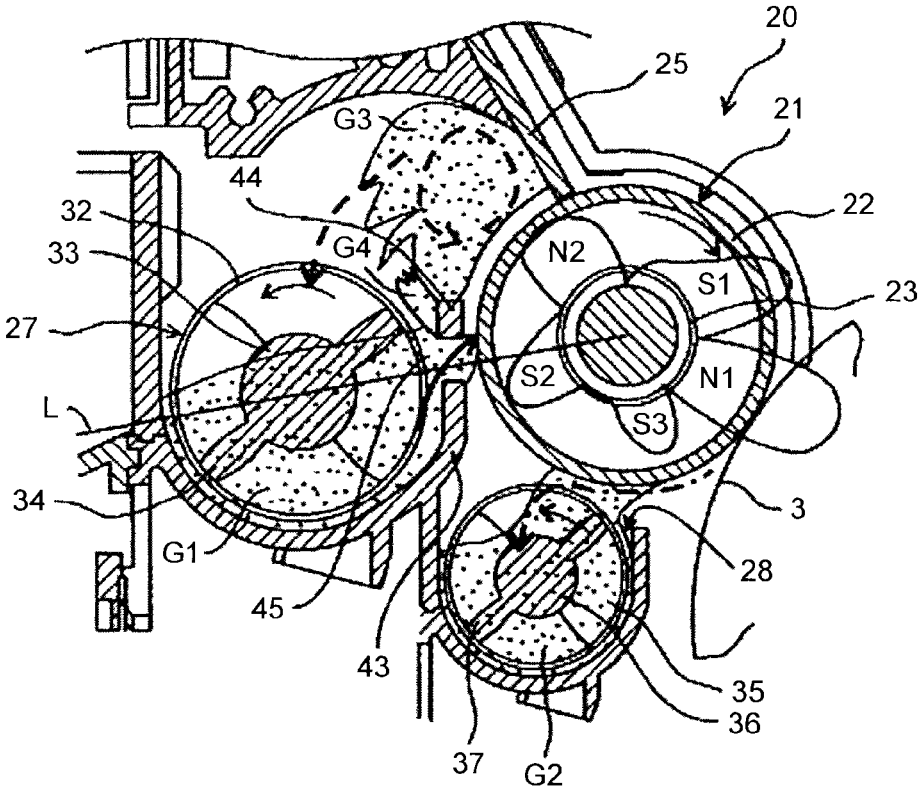
FIG. 2 illustrates a schematic configuration of a developing unit of the printer.

FIG. 2 illustrates a schematic configuration of the developing unit 20 of the toner image forming unit 1. M, C, Y and K that are reference symbols to identify colors will not be used in the following descriptions.

A drum-shaped photosensitive element 3 shown in FIG. 2 is disposed in a posture in which the drum-shaped photosensitive element 3 extends with its axial direction orthogonal to the plane of FIG. 2. In the developing unit 20, a developer supply conveyance path 27 and a developer collection conveyance path 28 both of which store a developer (not shown)

are disposed. A supply screw 32 serving as a developer supply conveyance member is rotatably housed in the developer supply conveyance path 27. A receiving screw 35 serving as a developer collection conveyance member is rotatably housed in the developer collection conveyance path 28.

A developing roller 21 is disposed with the circumferential surface of a developing sleeve 22 partly exposed via an opening formed on the casing on a side opposed to a photosensitive element 3. The developing sleeve 22 is opposed to the developer supply conveyance path 27 and the developer collection conveyance path 28 almost all over the area in its axial direction on the opposite side to the side on which the developing sleeve 22 is opposed to the photosensitive element 3. The developer collection conveyance path 28 is disposed below the developing roller 21 and the developer supply conveyance path 27 is disposed in a position slightly shifted below with respect to the position right beside the developing roller 21.

The supply screw 32 stored in the developer supply conveyance path 27 is made from a non-magnetic material, such as resin, and is in a posture as extending horizontally as the photosensitive element 3 and the developing roller 21 are. A cylindrical rotation shaft member 33 and a screw blade 34 that is spirally provided on the circumferential surface of the rotation shaft member 33 are integrally driven to rotate counterclockwise by a drive unit (not shown) including a motor and a drive transmission system as illustrated in FIG. 2.

The receiving screw 35 housed in the developer collection conveyance path 28 is in a posture in which it extends horizontally as the photosensitive element 3, the developing roller 21, and the supply screw 32 are. The rotation shaft member 36 made from a non-magnetic material, such as resin, and the screw blade 37 are driven to rotate counterclockwise integrally by a drive unit (not shown).

The developer supply conveyance path 27 and the developer collection conveyance path 28 are partitioned with a partition wall 43 that forms a side wall on the side of the developer supply conveyance path 27. Openings are formed on both ends of the partition wall 43 in the axial direction of the developing roller and the developer supply conveyance path 27 and the developer collection conveyance path 28 communicate, via the openings.

In the developer supply conveyance path 27, a developer G1 held by the blade of the supply screw 32 is conveyed from the front side to the back side in the direction orthogonal to the plane of FIG. 2 in accordance with the rotation of the supply screw 32. In this conveyance process, the developer G1 is sequentially supplied to the developing sleeve 22 over the upper end of the partition wall 43 as indicated by the solid arrow shown in FIG. 2 and is drawn up onto the surface of the developing sleeve 22 by the magnetic force of the magnet roller 23 (drawing-up magnetic force) in the developing sleeve 22. The developer G1 that is not drawn up onto the surface of the developing sleeve 22 and is conveyed to an area around the downstream end of the developer supply conveyance path 27 in the direction in which the developer is conveyed (around the back side in FIG. 2) falls into the developer collection conveyance path 28 via the opening of the partition wall 43.

The developer G2 that is conveyed to the developing area in accordance with the rotation of the developing sleeve and that contributes to developing is then conveyed in accordance with the rotation of the developing sleeve 22 to a position opposed to the developer collection conveyance path 28. The developer G2 is then separated from the surface of the sleeve due to the effect of a repulsion magnetic field formed by the magnet roller 23 and falls into the developer collection conveyance path 28 as indicated by the dashed dotted line shown in FIG. 2.

In the developer collection conveyance path 28, the developer G2 that is held by the blade of the receiving screw 35 is conveyed from the back side to the front side in the direction orthogonal to the plane of the drawing in accordance with the rotation of the receiving screw 35. In the conveyance process, the toner supply device supplies toner. The developer that falls from the developer supply conveyance path 27 via the opening of the partition wall 43 is taken into an area around the upstream end of the developer collection conveyance path 28 in the direction in which the developer is conveyed (around the back end in FIG. 2). The developer that is conveyed by the receiving screw 35 to the area around the downstream end of the developer collection conveyance path 28 in the direction in which the developer is conveyed (around the front end in FIG. 2) is drawn up to the developer supply conveyance path 27 via the opening of the partition wall 43.

The magnet roller 23 according to the first embodiment has a configuration in which five magnetic poles N1, S1, N2, S2 and S3 are disposed along the developer-sleeve-surface moving direction. The pole N1 is a developing magnetic pole that generates a developing magnetic force for causing carrier chains in the developer carried on the surface of the developing sleeve 22 in the developing area. The magnetic pole S1 is a conveyance magnetic pole that generates a magnetic force for conveying the developer carried on the surface of the developing sleeve 22 in the developing area. The magnetic pole N2 is a control magnetic pole that generates a control magnetic force for causing carrier chains in the developer when the developer passes through the control gap that is formed between the surface of the developing sleeve 22 and a doctor blade 25 serving as a developer control member. The magnetic pole S2 is a drawing-up magnetic pole that generates a magnetic force for drawing-up the developer onto the surface of the developing sleeve 22. The magnetic pole S2 is a magnetic pole for forming the repulsion magnetic field in corporation with the magnetic pole S2 so as to separate the developer from the surface of the developing sleeve 22 and collect the developer into the developer collection conveyance path 28.

A developing unit of a conventional image forming device will be described here.

Figure 9:
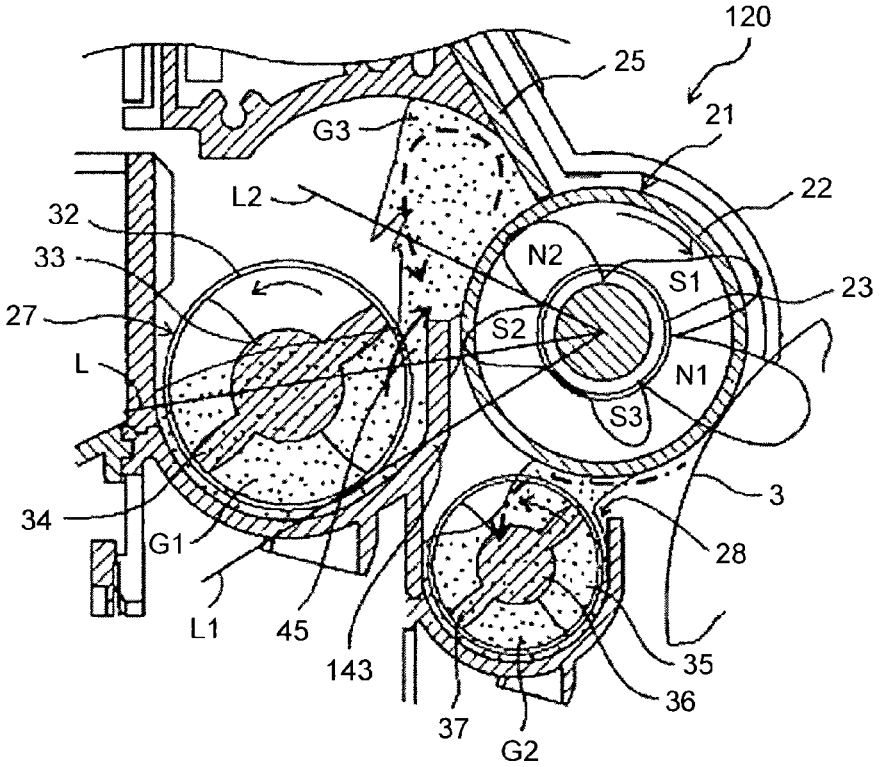
FIG. 9 illustrates an exemplary conventional developing unit in which no shield wall is provided.

FIG. 9 illustrates an exemplary conventional developing unit.

The position of the upper end of a partition wall 143 of a developing unit 120 is higher than that of the developing unit 20 of the first embodiment illustrated in FIG. 2 and the developing unit 120 is not provided with a shield wall (prevention member) 44 of the developing unit 20 of the first embodiment.

In the developing unit 120 with such a configuration, the control magnetic force from the control magnetic pole N2 acts on the developer G3 that is prevented from passing through the control gap, which leads to a situation that the developer G3 is retained in a control retaining space adjacent to the doctor blade 25 on the downstream side with respect to the doctor blade 25 in the developing-sleeve-surface moving direction. The control retained developer G3 is retained in the control retaining space while, as indicated by the dotted arrow shown in FIG. 9, being rotated (circulating) in the opposite direction to that of the rotation of the developing sleeve 22 in the control retaining space due to the move of the surface of the developing sleeve 22. The developer G1 that is thrown up by the supply screw 32 may be taken into the control retained developer G3. Triboelectric charging of the control retained developer G3 progresses while the control retained developer G3 circulates in the control retaining space while being applied with the binding force of the control magnetic force and accordingly the amount of toner charge becomes abnormally larger than that of the developer G1 in the developer supply conveyance path 27. This causes a difference in developing capability between the control retained developer G3 and the developer G1 in the developer supply conveyance path 27. Even if the developers G1 and G3 with a different in developing capability are used for developing, image density unevenness that can be recognized by human is not caused as long as the developers G1 and G3 are mixed and dispersed uniformly. However, if the developers G1 and G3 that are not sufficiently mixed are used for developing, image density unevenness that can be recognized by human is caused, which causes image quality degradation.

In the conventional developing unit 120 illustrated in FIG. 9, the control retained developer G3 that escapes the binding with the control magnetic force while circulating is sequentially collected into the developer supply conveyance path 27. Once collected into the developer supply conveyance path 27, the developer G3 is sufficiently mixed with the developer G1 and then is drawn up again, which does not cause the above-described image quality degradation. However, the magnetic pole S2 with the opposite polarity to that of the control magnetic pole N2 is disposed as adjacent to the magnetic pole N2 on the upstream side with respect to the magnetic pole N2 in the developer-sleeve-surface moving direction. For this reason, in the conventional developing unit 120 illustrated in FIG. 9, a magnetic field with magnetic force lines going around to the drawing-up magnetic pole S2 via the control retained space is formed. In such a magnetic field, a part of the control retained developer G3 most close to the drawing-up magnetic pole S2 (the part most close to the upper end of the partition wall 143) moves toward the drawing-up magnetic pole S2 along the magnetic force lines and is attracted to the surface of the developing sleeve 22. Accordingly, a part of the control retained developer G3 is not collected into the developer supply conveyance path 27 and carried on the surface of the developing sleeve 22.

Here, if the developer G1 from the developer supply conveyance path G1 is sufficiently drawn up to the surface of the developing sleeve 22, the control retained developer G3 that is attracted by the drawing-up magnetic force is carried as being superimposed on the developer G1 on the surface of the developing sleeve 22. In this case, the control retained developer G3 is carried in an area distant from the surface of the developing sleeve and thus the doctor blade 25 prevents the developer G3 from passing through the control gap and the developer layer consisting of only the developer G1 is conveyed to the developing area. However, in the conventional developing unit shown in FIG. 9, the control retained developer G3 attracted by the drawing-up magnetic force hinders drawing-up of the developer G1 from the developer supply conveyance path 27. Particularly, the control retained developer G3 attracted by the drawing-up magnetic force hinders drawing up of a part of the developer G1 supplied to the developing sleeve in a spot where the force of the screw blade 34 of the supply screw 32 for sending out the developer toward the developing sleeve is weak (a spot where the circumferential end of the screw blade 34 has not passed through the vicinity of the developing sleeve 22). As a result, in such a spot, the control retained developer G3 attracted by the drawing-up magnetic force is carried in an area close to the surface of the developing sleeve 22, passes through the control gap, and is conveyed to the developing area. Accordingly, in the conventional developing unit illustrated in FIG. 9, a developer layer in which the control retained developer G3 with an abnormally large amount toner charge and the developer G1 with a normal amount of toner charge are not mixed sufficiently is sent into the developing area, which causes image density unevenness so that image quality degradation is caused.

Specifically, the conventional developing unit illustrated in FIG. 9 is a developing unit employing a supply collection separation system where the developer on the developing sleeve 22 that has passed through the developing area is collected into the developer collection conveyance path 28 different from the developer supply conveyance path 27. In such a developing unit, while being drawing up onto the surface of the developing sleeve 22, the developer G1 in the developer supply conveyance path 27 is conveyed toward the downstream end in the direction in which the developer is conveyed. Thus, the amount of the developer G1 flowing in the developer supply conveyance path 27 becomes smaller toward the downstream side in the direction in which the developer is conveyed and accordingly the amount of the developer G1 to be supplied to the developing sleeve 22 from the developer supply conveyance path tends to be insufficient in the downstream end of the developer supply conveyance path 27 in the direction in which the developer is conveyed. For this reason, in the downstream end of the developer supply conveyance path 27 in the direction in which the developer is conveyed, the control retained developer G3 attracted by the drawing-up magnetic force tends to prevent the developer G1 from being drawn up, which tends to cause image quality degradation due to image density unevenness.

For reducing such image quality degradation, as illustrated in FIG. 2, the developing unit 20 of the first embodiment has the following configuration: the partition wall 43 is made lower than the partition wall of the conventional developing unit 120 illustrated in FIG. 9 by lowering the position of the upper end of the partition wall 43 and the shield wall 44 serving as a prevention member is provided. The shield wall 44 is disposed in a position where the control retained developer G3 that is prevented from passing through the control gap by the doctor blade 25 is prevented from moving toward the front side of the developing sleeve 22 along the lines of the control magnetic force.

With the shield wall 44, the control retained developer G3 that is attracted by the drawing-up magnetic force does not prevent the developer G1 from being drawn up from the developer supply conveyance path 27. This tends not to cause a spot where the amount of the developer G1 to be drawn up from the developer supply conveyance path 27 is locally insufficient and tends not to cause the control retained developer G3 attracted by the drawing-up magnetic force to be carried the area close to the surface of the developing sleeve where the control retained developer G3 possibly passes through the control gap. This reduces occurrence of the situation where a developer layer in which the control retained developer G3 with an abnormally large amount of toner charge and the developer G1 with a normal amount of toner charge are not sufficiently mixed is sent into the developing area, which reduces image quality degradation due to image density unevenness.

The shield wall 44 of the first embodiment forms, between the shield wall 44 and the partition wall 43, a slit 45 serving as a supply path through which the developer G1 in the developer supply conveyance path 27 passes toward the developing sleeve 22 at least over an entire area along the direction of the rotation axis of the developing sleeve in the developing area. Thus, provision of the shield wall 44 does not hinder the operation of drawing up the developer G1 in the developer supply conveyance path 27 onto the surface of the developing sleeve 22. Specifically, in the first embodiment, in a view in the direction of the axis of the developing sleeve, the slit 45 is disposed in a position where the straight line L connecting the rotation center of the developing sleeve 22 and the rotation center of the supply screw 32 passes through the slit 45. Accordingly, the developer G1 in the developer supply conveyance path 27 can be supplied to the surface of the developing sleeve 22 in the minimum distance.

Figure 3:
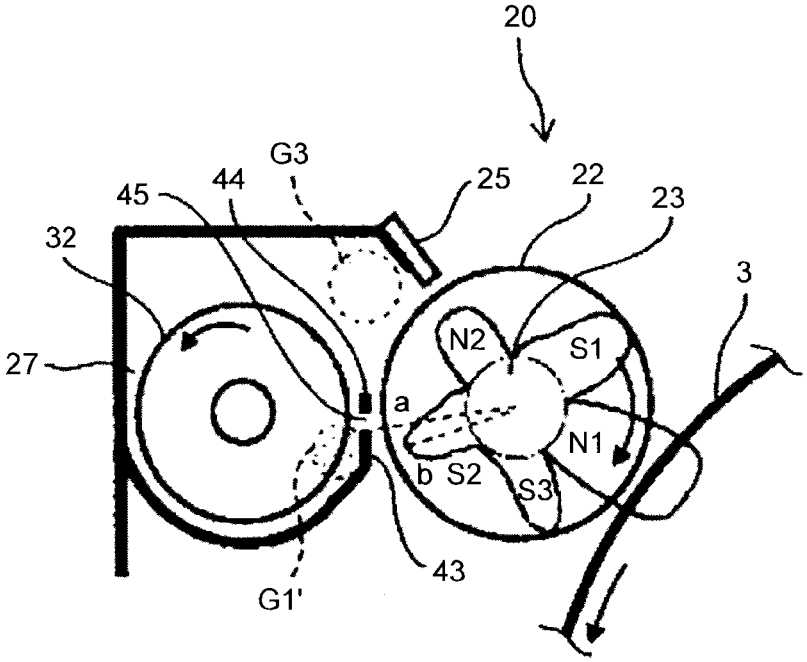
FIG. 3 illustrates an exemplary magnetic flux density distribution of a magnet roller in the normal direction in a developing unit.

FIG. 3 illustrates an exemplary magnetic density distribution of the magnet roller 23 of the developing unit 20 according to the first embodiment in the normal direction. In the first embodiment, the drawing-up magnetic pole S2 of the magnet roller 23 is disposed such that the peak of the magnetic flux density of the drawing-up magnetic pole S2 in the normal direction is below the lower end of the slit 45. In other words, the drawing-up magnetic pole S2 is disposed such that the straight line b connecting the center of rotation of the developing sleeve 22 to the peak of magnetic flux density of the drawing-up magnetic pole S2 in the normal direction on the circumference is below the line a connecting the center of rotation of the developing sleeve 22 and the lower end of the slit 45.

Such disposition of the drawing-up magnetic pole S2 increases the effect that, with the drawing-up magnetic force generated by the drawing-up magnetic pole S2, the developer G1 in the developer supply conveyance path 27 below the lower end of the slit 45 is attracted toward the developing sleeve 22. Accordingly, while being attracted toward the developing sleeve 22 with the drawing-up magnetic force generated by the drawing-up magnetic pole S2, the developer G1 in the developer supply conveyance path 27 below the lower end of the slit 45 can be conveyed by the supply screw 32 to pass through the slit 45. Thus, even if the amount of the developer near the supply screw 32 is small or even when the supply screw 32 is in a shape with low capability of conveying the developer in the rotation direction of the supply screw 32, the amount of the developer G1 to pass through the slit 45 can be increased to a sufficient amount. This prevents occurrence of a situation where a developer layer in which the control retained developer G3 with an abnormally large amount of toner charge and the developer G1 other than the control retained developer G3 with a normal amount of toner charge are not sufficiently mixed is sent into the developing area, which reduces image quality degradation due to image density unevenness.

Figure 10:
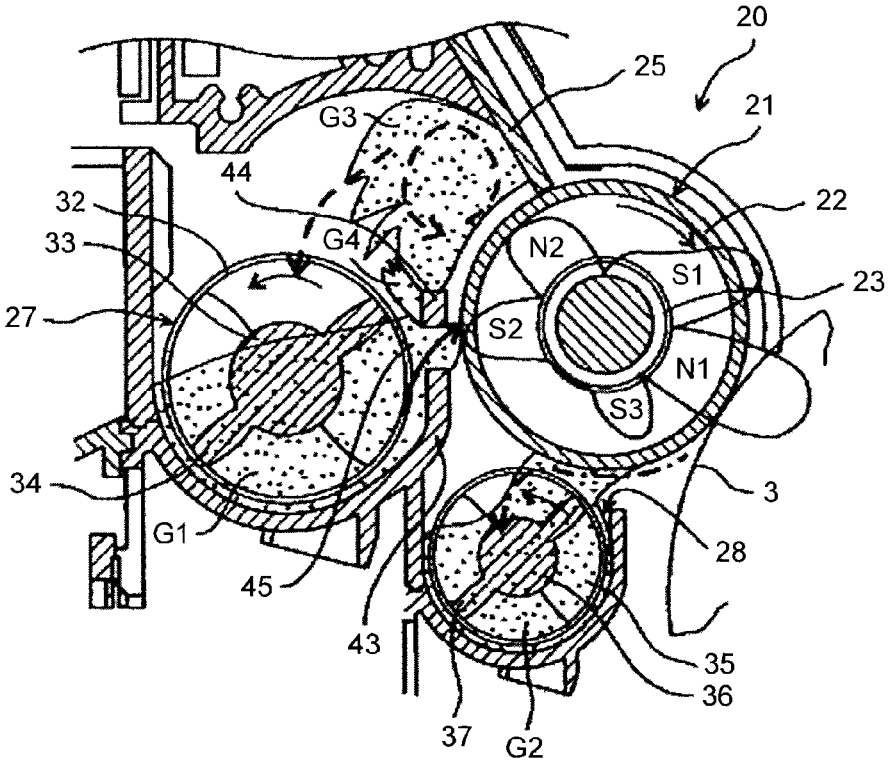
FIG. 10 illustrates the developing unit according to Japanese Laid-open Patent Publication No. 2012-108466.

FIG. 10 illustrates the developing unit according to Japanese Laid-open Patent Publication No. 2012-108466. In the developing unit according to Japanese Laid-open Patent Publication No. 2012-108466, the drawing-up magnetic pole S2 is disposed such that the magnetic flux density peak of the drawing-up magnetic pole S2 in the normal direction is opposed to an upper part of the slit 45. The drawing-up magnetic force generated by the drawing-up magnetic pole S2 causes the developer, which is conveyed by the supply screw 32, to pass through the slit 45, to be attracted toward the developing sleeve 22, and to be drawn up onto the developing sleeve 22. With this configuration, the drawing-up magnetic force is weak below the lower end of the slit 45. Thus, if the amount of the developer near the supply screw 32 in the developer supply conveyance path 27 is small or if the supply screw 32 has low capability of conveying the developer in its rotation direction, the amount of the developer to be supplied from the developer supply conveyance path 27 to the developing sleeve 22 via the slit 45 is reduced. This may lead to a situation that a developer layer in which the control retained developer G3 with an abnormally large amount of toner charge and the developer G1 other than the control retained developer G3 with a normal amount of toner charge are not sufficiently mixed is conveyed to the developing area, which may cause image quality degradation due to image density unevenness.

Furthermore, the configuration in which the developer G1 is conveyed by the supply screw 32 to pass through the slit 45 has a problem in the that the amount of the developer G1 to pass through the slit 45 tends to vary according to the blade pitch of the supply screw 32, which tends to cause image intensity unevenness according to the blade pitch. This results from the fact that, while the front side of the blade with respect to the direction in which the developer is conveyed (the direction of the rotation axis) holds the developer and thus there is a sufficient amount of the developer, there is a small amount of the developer on the back side of the blade.

In the developing unit 20 of the first embodiment, the drawing-up magnetic pole S2 of the magnet roller 23 is disposed such that the magnetic flux density peak of the drawing-up magnetic pole S2 in the normal direction is below the lower end of the slit 45. The drawing-up magnetic force generated by the drawing-up magnetic pole S2 causes the developer G1, which is attracted toward the developing sleeve 22, to be partly held by the partition wall 43 under the slit 45 (indicated by G1' shown in FIG. 3). In such a state, even if the amount of the developer to be conveyed toward the slit 45 is reduced on the back side of the screw blade of the supply screw 32, the developer G1' held by the partition wall 43 is conveyed toward the slit 45, passes through the slit 45, and is supplied to the developing sleeve 22. This controls the problem that the amount of the developer to pass through the slit 45 varies according to the blade pitch and image density unevenness tends to be caused according to the blade pitch.

Figure 4:
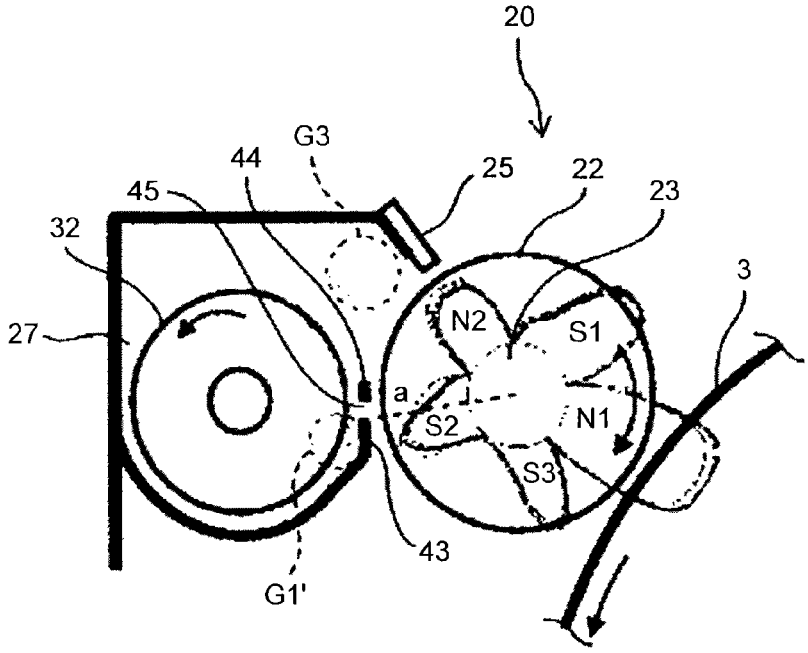
FIG. 4 illustrates another exemplary magnetic flux density distribution of the magnet roller in the normal direction in the developing unit.

FIG. 4 illustrates an exemplary another magnetic flux density distribution of the magnet roller 23 of the developing unit 20 in the normal direction according to the first embodiment. Every magnet roller 23 shown in FIG. 4 is disposed such that the magnetic flux density peak of the drawing-up magnetic pole S2 in the normal direction is below the lower end of the slit 45 so that the above-described effect can be implemented.

Figure 5:
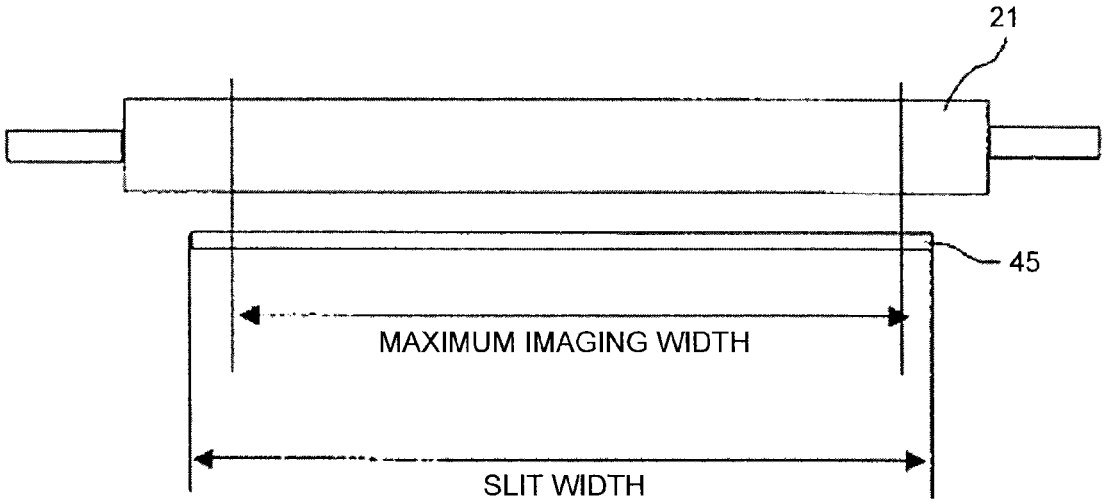
FIG. 5 illustrates a relationship between the width of a slit and a maximum width of an imaging area in the developing unit.

The length of the slit 45 in the developing-sleeve rotation-axis direction in the first embodiment is set larger than the width of the maximum imaging area as illustrated in FIG. 5. If the length of the slit 45 in the developing-sleeve rotation-axis direction is smaller than the width of the maximum imaging area, a problem occurs. Specifically, the developer G1 that has passed through the slit 45 and has moved as going around in the developing-sleeve rotation-axis direction is carried on a part of the surface of the developing sleeve 22, which is the part corresponding to both ends of the maximum imaging area in the developing-sleeve rotation-axis direction. Accordingly, the amount of the developer G1 to be carried on to the part of the surface of the developing sleeve 22 corresponding to both ends of the maximum imaging area tends to be insufficient. Thus, the shortage of the developer on the part of the surface of the developing sleeve 22 is compensated with the control retained developer G3 in the control retaining space. As a result, when image forming is performed on the maximum imaging area, image density unevenness is caused between the center part and the ends in the developing-sleeve rotation-axis direction, which causes image quality degradation. In the first embodiment, because the length of the slit 45 in the developing-sleeve rotation-axis direction is set larger than the width of the maximum imaging area, such image quality degradation is not caused.

The opening width of the slit 45 (the length in the developing-sleeve-surface moving direction) is preferably 2 mm or more. If the opening width is less than 2 mm and when carriers with a volume mean diameter of approximately 50 μm are used, it is difficult for the developer G1 to pass through the slit 45 smoothly with the drawing-up magnetic force acting thereon. If the developer G1 cannot pass through the slit 45 smoothly, the amount of the developer G2 to be drawn up onto the surface of the developing sleeve 22 becomes insufficient and the control retained developer G3 is supplied to compensate the shortage, passes through the control gap, and is conveyed to the developing area. This may cause image quality degradation due to image density unevenness. If the opening width is 2 mm or more, the developer G1 can pass through the slit 45 smoothly even when carriers with a volume mean diameter of approximately 50 μm are used. For this reason, particularly with a developer with recently-available carriers having a smaller diameter, the developer G1 can pass through the slit 45 smoothly steadily. This avoids that the developer G1 cannot pass through the slit 45 smoothly and thus, due to image density unevenness, image quality degradation is caused.

Because variation in the amount of the developer to be conveyed to the developing area has a great effect on the developing capability, the amount of the developer is controlled with the control gap between the doctor blade 25 and the surface of the developing sleeve 22 such that a given amount of the developer is steadily sent to the developing area. If the shield wall gap between the shield wall 44 and the surface of the developing sleeve 22 (the gap where the shield wall 44 and the developing sleeve 22 are most close to each other) is narrower than the control gap, the amount of the developer that is carried on the surface of the developing sleeve 22 and that passes through the shield wall gap is smaller than the amount of the developer that passes through the control gap. For this reason, even when the developer that passes through the shield wall gap contains only the developer G1, which is drawn up from the developer supply conveyance path 27, and does not contain the control retained developer G3, the developer layer in which the control retained developer G3 is superimposed onto the developer G1 passes through the control gap. If the control retained developer G3 is dispersed uniformly in the developer layer that passes through the control gap, the above-described image quality degradation due to image density unevenness is not caused. However, the developer layer that contains a large amount of the control retained developer with an abnormally large amount of toner charge contributes to developing in the developing area, which results in an inconvenience that normal image density cannot be obtained.

For this reason, in the first embodiment, the shield wall gap between the shield wall 44 and the surface of the developing sleeve 22 is set the same as or larger than the control gap. Thus, a developer layer to pass through the control gap is a developer layer that has passed through the shield gap, i.e., a developer layer consisting of only the developer G1 with a normal amount of toner charge that is drawn up from the developer supply conveyance path 27. Accordingly, this solves the above-described inconvenience that normal image density cannot be obtained.

Second Embodiment

Another embodiment (hereinafter, "second embodiment") of an electrophotographic printer will be described as an image forming apparatus to which the present invention is applied.

An overall configuration of the image forming apparatus of the second embodiment is the same as that of the image forming apparatus of the first embodiment illustrated in FIG. 1 and the basic configuration of the developing unit 20 is the same as the developing unit 20 illustrated in FIG. 2.

In the following descriptions, only different aspects from those of the first embodiment will be given and the same aspects as those of the first embodiment will not be given.

Figure 6:
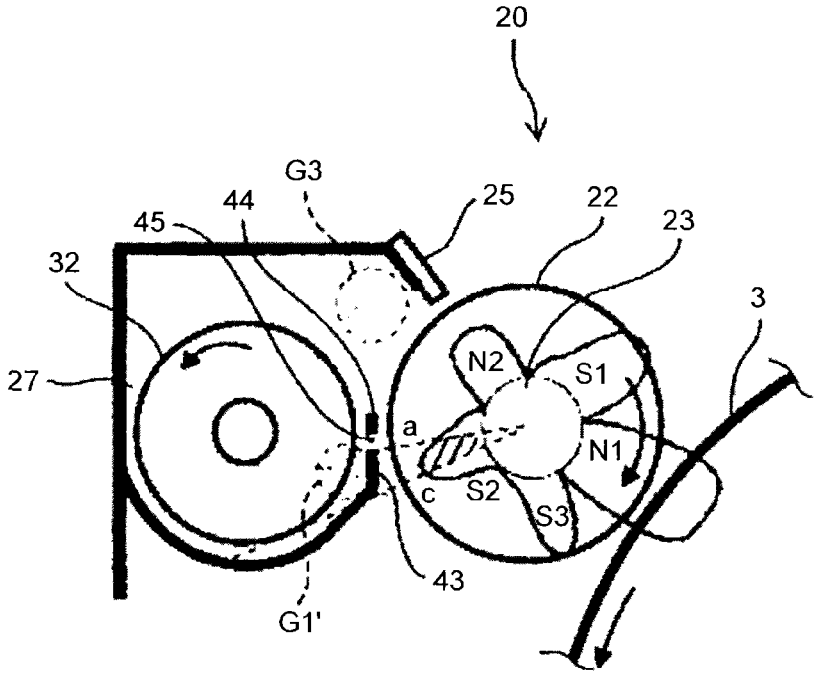
FIG. 6 illustrates an exemplary magnetic flux density distribution of a magnet roller in the normal direction in a developing unit according to a second embodiment.

FIG. 6 illustrates an exemplary magnetic density flux distribution of the magnet roller 23 in the normal direction on the circumferential surface of the developing unit 20 according to the second embodiment. FIG. 6 shows a line a connecting the center of rotation of the developing sleeve 22 and the lower end of the slit 45 and a tangent c connecting the center of rotation of the developing sleeve 22 and the circumference of the supply screw 32 below the slit 45.

In the second embodiment, the magnetic flux density of the drawing-up magnetic pole S2 of the magnet roller 23 of the developing unit 20 in the normal direction on the surface of the developing sleeve 22 satisfies the following conditions: the total magnetic flux density in the area surrounded by the line a connecting the center of rotation of the developing sleeve 22 and the lower end of the slit 45 and the tangent c connecting the center of rotation of the developing sleeve 22 and the circumference of the supply screw 32 below the slit 45 is equal to or larger than 700 mT·deg. The line a connecting the center of rotation of the developing sleeve 22 and the lower end of the slit 45 will be referred to as the "supply slit lower end a" below and the tangent c connecting the center of rotation of the developing sleeve 22 and the circumference of the supply screw 32 below the slit 45 will be referred to as the screw outer diameter tangent c" below.

Figure 7:
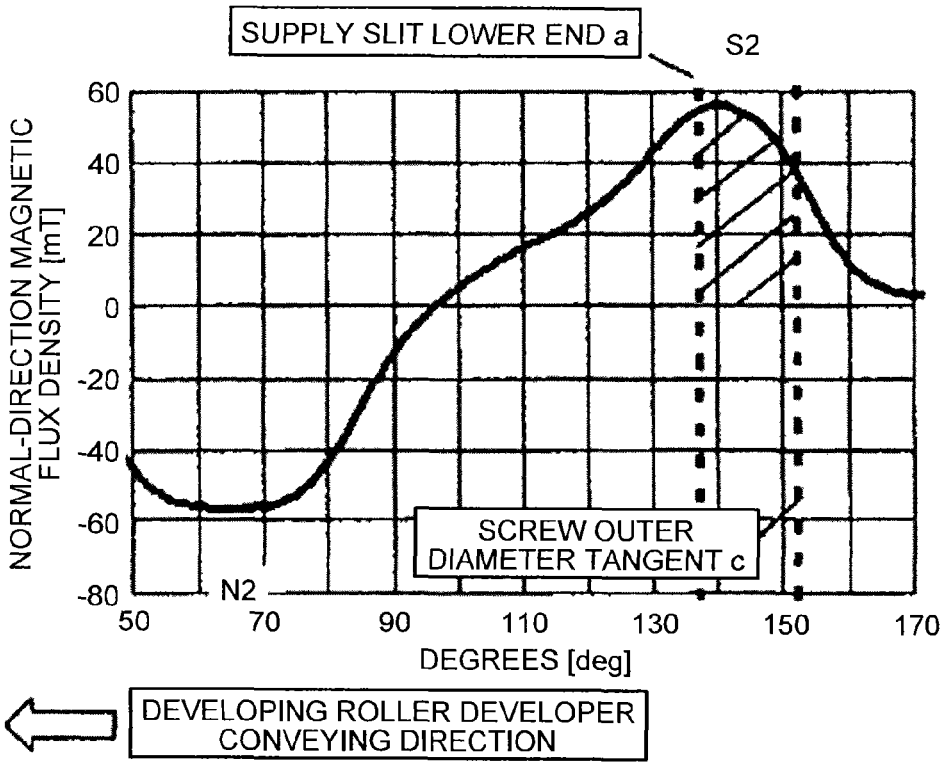
FIG. 7 is a graph of exemplary magnetic flux density of a drawing-up magnetic pole S2 and a control magnetic pole N1 of the magnet roller in the normal direction on the surface of a developing sleeve.

FIG. 7 is a graph of exemplary magnetic flux density of the drawing-up magnetic pole S2 and the control magnetic pole N1 of the magnet roller 23 according to the second embodiment in the normal direction on the surface of the developing sleeve 22. The horizontal axis of the graph represents the angle with respect to the center of the rotation axis of the developing sleeve 22 and the vertical axis of the graph represents the magnetic flux density in the normal direction measured on the surface of the developing sleeve 22. Because the angle represented by the horizontal axis represents the angle of a given reference position to the center of rotation of the developing sleeve 22, the value varies according to the reference position at 0 degrees.

The shaded area shown in FIG. 7 corresponds to the total magnetic flux density of the drawing-up magnetic pole S2 in the normal direction on the surface of the developing sleeve 22 in the area surrounded by the supply slit lower end a and the screw outer diameter tangent c. The total magnetic flux density of the magnet roller 23 represented in FIG. 7 is 812 mT·deg.

With the magnet roller 23, a sufficient drawing-up magnetic force acts on the developer G1 in the supply screw 32 and below the end of the slit 45. Thus, while being attracted toward the developing sleeve 22, the developer G1 below the slit 45 can be conveyed by the supply screw 32 to pass through the slit 45. Accordingly, even if the amount of the developer near the supply screw 32 is small or even if the supply screw has low capability of conveying the developer in its rotation direction, the amount of the developer G1 to pass through the slit 45 can be increased to a sufficient amount. This reduces occurrence of a situation where a developer layer in which the control retained developer G3 with an abnormally large amount of toner charge and the developer G1 other than the control retained developer G3 with a normal amount of toner charge are not sufficiently mixed is sent into the developing area, which reduces image quality degradation due to image density unevenness.

In the developing unit 20, the drawing-up magnetic force generated by the drawing-up magnetic pole S2 of the magnet roller 23 causes the developer G1, which is attracted toward the developing sleeve 22, to be partly held by the partition wall 43 under the slit 45 (indicated by G1' shown in FIG. 6). In such a state, even if the amount of the developer to be conveyed toward the slit 45 is reduced on the back side of the screw blade of the supply screw 32, the developer G1' held by the partition wall 43 is conveyed toward the slit 45, passes through the slit 45, and is supplied to the developing sleeve 22. This controls the problem that the amount of the developer to pass through the slit 45 varies according to the blade pitch of the supply screw 32 and image density unevenness tends to be caused according to the blade pitch.

Figure 8:
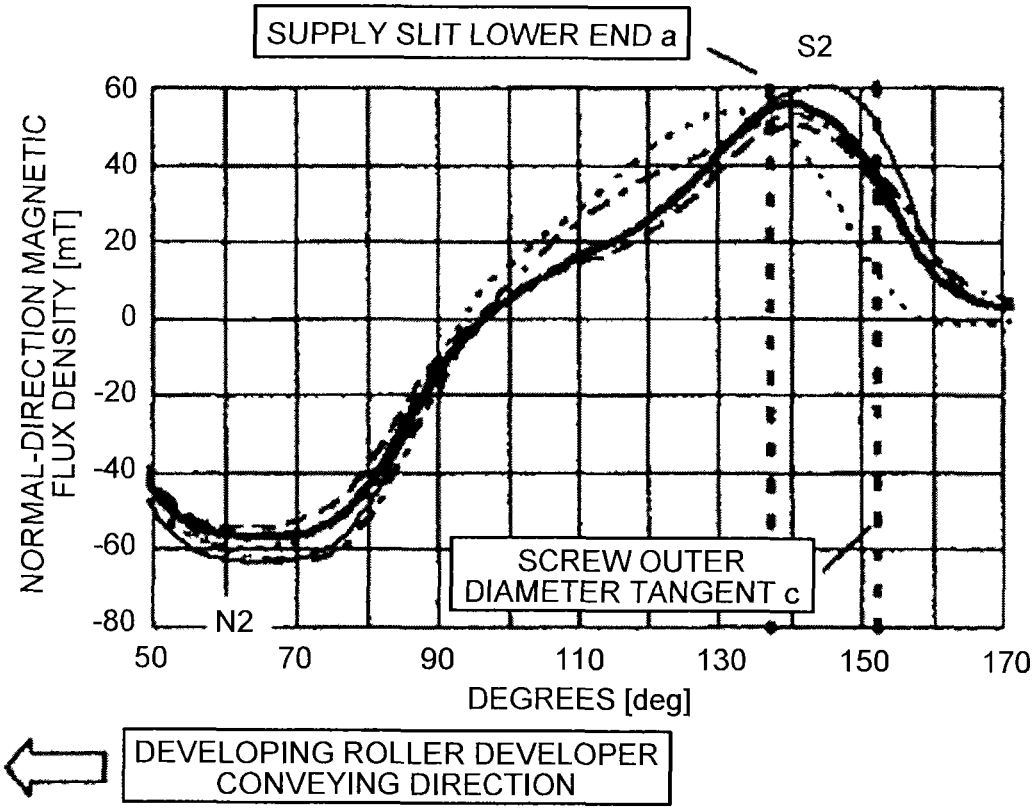
FIG. 8 is a graph of the magnetic flux density of a drawing-up magnetic pole S2 and a control magnetic pole N1 of a magnet roller that was used for an experiment in the normal direction on the surface of a developing sleeve.

An experiment will be described here where the total magnetic flux density in the normal direction on the surface of the developing sleeve 22 in the area surrounded by the supply slit lower end a and the screw outer diameter tangent c was set equal to or larger than 700 mT·deg. FIG. 8 represents a graph of magnetic flux density of the drawing-up magnetic pole S2 and the control magnetic pole N1 of the magnet roller 23 that was used for the experiment in the normal direction. As FIG. 8 indicates, the shape of the magnetic flux density distribution in the area surrounded by the supply slit lower end a and the screw outer diameter tangent c was plotted, a whole solid image and a halftone image were output, and the images were evaluated on whether there is intensity unevenness.

Other conditions on the developing unit 20 were as follows: a two-component developer that contains carriers with a weight average particle diameter of 35 μm and toner with a weight average particle diameter of 4.9 μm was used; the developing sleeve 22 had a diameter of 30 mm, irregularities on its surface with ten point average roughness Rz (JIS) of 36±10 μm, and a rotational speed of 422 rpm; the supply screw 32 had an outer diameter of 30 mm, a shaft diameter of 8 mm, and rotational speed of 432 rpm; for the screw blade of the supply screw 32, a double-start thread with a pitch of 52 mm was used; the partition wall 43 had a thickness of 2 mm; the slit 45 had an opening width of 3 mm; the center of rotation of the supply screw was 6 mm below the center of rotation of the developing sleeve 22; and the upper end of the shield wall 44 was 1 mm higher than the center of rotation of the developing sleeve 22; and the lower end of the slit 45 is 5 mm below the center of rotation of the developing sleeve 22; and the gap between the supply screw 32 and the partition wall 43 and the gap between the developing sleeve 22 and the partition wall 43 was 1 mm.

roller 23, housed in the developer carrier and that rotates, with a developer carried on its surface with a magnetic force that is generated by the magnetic field generator, so as to convey the developer to a developing area where the developer is opposed to the surface of a latent image carrier, such as the photosensitive element 3; a developer control member, such as the doctor blade 25, that forms, between the developer control member and the surface of the developer carrier, a control gap through which the developer carried on the surface of the developer carrier passes and accordingly the amount of the developer to be conveyed to the developing area is controlled; and the developer supply conveyance path 27 that is disposed adjacent to the surface of the developer carrier, in which a developer G1 to be supplied onto the surface of the developer carrier is conveyed with a developer supply conveyance member, such as the supply screw 32, along the direction of the rotation axis of the developer carrier, and into which a developer G3 that is prevented by the developer control member from passing through the control gap is collected. The magnetic field generator includes at least: a drawing-up magnetic pole S2 that generates a drawing-up magnetic force for attracting the developer G1 in the developer supply conveyance path toward the developer carrier over the upper end of a side wall, such as the partition wall 43, on the side of the developer carrier in the developer supply conveyance path and for drawing up the developer G1 to the surface of the developer carrier; and a control magnetic pole N2 that generates a control magnetic force for causing carrier chains in the developer that is passing through the control gap. The drawing-up magnetic pole S2 and the control magnetic pole N2 are adjacent to each other in the direction in which the surface of the developer carrier moves and have polarities opposite to each other. The shield wall 44 serving as a prevention member is provided that secures, between the shield wall 44 and the upper end of the partition wall 43, a supply path, such as the slit 45, through which the developer G1 in the developer supply conveyance path passes toward the developer carrier at least over an entire area along the direction of the rotation axis of the developer carrier in the developing area and that prevents the control retained developer G3, which is prevented by the developer control member from passing through the control gap, from moving toward the surface of the developer carrier along lines of the control magnetic force. In the developing device, the peak of the

TABLE 1

| | TOTAL NORMAL-DIRECTION MAGNETIC FLUX DENSITY (mT · deg) | | | | | | | | |
|---|---|---|---|---|---|---|---|---|---|
| | 538 | 583 | 654 | 693 | 701 | 719 | 765 | 811 | 931 |
| TEMPERATURE UNEVENNESS | FOUND | FOUND | FOUND | PARTLY FOUND | NOT FOUND | NOT FOUND | NOT FOUND | NOT FOUND | NOT FOUND |

As TABLE 1 represents, keeping the total magnetic flux density in the normal direction on the surface of the developing sleeve 22 in the area surrounded by the supply slit lower end a and the screw outer diameter tangent c at 700 mT·deg or larger preferably controlled concentration unevenness in the whole solid image and the halftone image.

The above-described experiment is an example only and the present invention implements unique effects in each mode.

Mode A

A developing device, such as the developing unit 20, includes a developer carrier, such as the developing sleeve 22, that includes a magnetic field generator, such as the magnet magnetic flux density of the drawing-up magnetic pole S2 in the normal direction is disposed below the lower end of the slit 45.

In Mode A, the peak of the magnetic flux density of the drawing-up magnetic pole S2 in the normal direction is below the lower end of the supply path, which increases the effect that the developer G1 in the developer conveyance path below the lower end of the supply path is attracted toward the developer carrier by the drawing-up magnetic force generated by the drawing-up magnetic pole. Accordingly, it is possible to, while attracting the developer G1 in the developer conveyance path below the lower end of the supply path toward the developer carrier with the drawing-up magnetic force generated by the drawing-up magnetic pole, convey the developer G1 with the developer supply conveyance member and causes the developer G1 to pass through the supply path. This aspect can be compared with the disposition of the drawing-up magnetic pole S2 according to Japanese Laid-open Patent Publication No. 2012-108466 and, when the amount of the developer near the developer supply conveyance member is small or when the developer supply conveyance member has low capability of conveying the developer in its rotation direction, the amount of the developer G1 to pass through the supply path can be increased to a sufficient amount. This reduces occurrence of the situation where a developer layer in which the control retained developer G3 with an abnormally large amount of toner charge and the developer G1 other than the control retained developer G3 with a normal amount of toner charge are not sufficiently mixed is sent into the developing area, which reduces image quality degradation due to image density unevenness.

Mode B

A developing device, such as the developing unit 20, includes a developer carrier, such as the developing sleeve 22, that includes a magnetic field generator, such as the magnet roller 23, housed in the developer carrier and that rotates, with a developer carried on its surface with a magnetic force that is generated by the magnetic field generator, so as to convey the developer to a developing area where the developer is opposed to the surface of a latent image carrier, such as the photosensitive element 3; a developer control member, such as the doctor blade 25, that forms, between the developer control member and the surface of the developer carrier, a control gap through which the developer carried on the surface of the developer carrier passes and accordingly the amount of the developer to be conveyed to the developing area is controlled; and the developer supply conveyance path 27 that is disposed adjacent to the surface of the developer carrier, in which a developer G1 to be supplied onto the surface of the developer carrier is conveyed with a developer supply conveyance member, such as the supply screw 32, along the direction of the rotation axis of the developer carrier, and into which a developer G3 that is prevented by the developer control member from passing through the control gap is collected. The magnetic field generator includes at least: a drawing-up magnetic pole S2 that generates a drawing-up magnetic force for attracting the developer G1 in the developer supply conveyance path toward the developer carrier over the upper end of a side wall, such as the partition wall 43, on the side of the developer carrier in the developer supply conveyance path and for drawing up the developer G1 to the surface of the developer carrier; and a control magnetic pole N2 that generates a control magnetic force for causing carrier chains in the developer that is passing through the control gap. The drawing-up magnetic pole S2 and the control magnetic pole N2 are adjacent to each other in the direction in which the surface of the developer carrier moves and have polarities opposite to each other. The shield wall 44 serving as a prevention member is provided that secures, between the shield wall 44 and the upper end of the partition wall 43, a supply path, such as the slit 45, through which the developer G1 in the developer supply conveyance path passes toward the developer carrier at least over an entire area along the direction of the rotation axis of the developer carrier in the developing area and that prevents the control retained developer G3, which is prevented by the developer control member from passing through the control gap, from moving toward the surface of the developer carrier along lines of the control magnetic force. In the developing device, a total magnetic flux density of the drawing-up magnetic pole S2 in the normal direction in an area surrounded by a line a connecting the center of rotation of the developer carrier and the lower end of the supply path and a tangent c connecting the center of rotation of the developer carrier and the circumference of the developer supply conveyance member below the supply path on the surface of the developer carrier is equal to or larger than 700 mT·deg.

In Mode B, the total magnetic flux density of the drawing-up magnetic pole S2 in the normal direction in the above-described area is 700 mT·deg or larger so that a sufficient amount of the drawing-up magnetic force acts on the developer G1 in the developer supply conveyance member. Thus, while being attracted toward the developer carrier, the developer G1 below the supply path can be conveyed by the developer supply conveyance member and pass through the supply path. This aspect can be compared to the disposition of the drawing-up magnetic pole S2 according to Japanese Laid-open Patent Publication No. 2012-108466, and when the amount of the developer near the developer supply conveyance member is small or when the developer supply conveyance member has low capability of conveying the developer in its rotation direction, the amount of the developer G1 to pass through the supply path can be increased to a sufficient amount. As the experiment of the second embodiment represents, this reduces occurrence of the situation where a developer layer in which the control retained developer G3 with an abnormally large amount of toner charge and the developer G1 other than the control retained developer G3 with a normal amount of toner charge are not sufficiently mixed is sent into the developing area, which reduces image quality degradation due to image density unevenness.

Mode C

In Mode A or Mode B, the developer supply conveyance member is a screw member, such as the supply screw 32, and the drawing-up magnetic force of the drawing-up magnetic pole S2 causes the developer in the developer supply conveyance path to be held by the side wall, such as the partition wall 43, on the side of the developer carrier and below the supply path in the developer supply conveyance path.

The configuration where a screw member is used for the developer supply conveyance member has a problem in that the amount of the developer G1 to pass through the supply path tends to vary according to the blade pitch of the screw member, which tends to cause image intensity unevenness according to the blade pitch. This results from the fact that, while the front side of the blade with respect to the direction in which the developer is conveyed (direction of the rotation axis) holds the developer and thus there is a sufficient amount of the developer, there is a small amount of the developer on the back side of the blade.

In Mode C, the drawing-up magnetic force generated by the drawing-up magnetic pole S2 causes the developer G1, which is attracted toward the developing sleeve 22, to be partly held by the partition wall 43 under the supply path (indicated by G1' shown in FIG. 3). In such a state, even if the amount of the developer is reduced on the back side of the screw blade of the screw member, the developer G1' held by the partition wall 43 is conveyed toward the supply path, passes through the supply path, and is supplied to the developer carrier. This controls the problem that the amount of the developer to pass through the supply path varies according to the blade pitch of the screw member and image density unevenness tends to be caused according to the blade pitch.

Mode D

An image forming apparatus that includes: a latent image carrier, such as the photosensitive element 3; a latent image forming unit, such as the charging device 4 and the optical writing unit 10, that forms a latent image on the latent image carrier; and a developing device that develops the latent image on the latent image carrier with a developer that contains toner and carriers, and that forms an image on a recording material by transferring a toner image, which is formed by the developing device on the latent image carrier, onto the recording material, uses the developing device according to any one of Modes A to C is used as the developing device. Accordingly, as described above, a high-quality image without image density unevenness can be obtained.

Mode E

A process cartridge in which at least a latent image carrier and a developing device are held integrally and that can be attached to and detached from an image forming apparatus uses the developing device according to any one of Modes A to C as the developing device. This makes it possible to improve the maintenance while reducing the image density unevenness.

According to an aspect of the present invention, an outstanding effect can be implemented that occurrence of a situation where a developer layer in which the control retained developer and the developer other than the control retained developer drawn up from the developer supply conveyance path are not sufficiently mixed is sent into the developing area is reduced, which reduces image quality degradation due to image density unevenness.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device comprising:

a developer carrier that includes a magnetic field generator housed in the developer carrier, and that rotates, with a developer containing toner and magnetic carriers and carried on a surface of the developer carrier with a magnetic force that is generated by the magnetic field generator, so as to convey the developer to a developing area where the developer is opposed to the surface of a latent image carrier;

a developer control member that forms, between the developer control member and the surface of the developer carrier, a control gap through which the developer carried on the surface of the developer carrier passes and accordingly the amount of the developer to be conveyed to the developing area is controlled; and a developer supply conveyance path that is disposed adjacent to the surface of the developer carrier, in which the developer to be supplied onto the surface of the developer carrier is conveyed with a developer supply conveyance member along a direction of a rotation axis of the developer carrier, and into which the developer that is prevented by the developer control member from passing through the control gap is collected, wherein the magnetic field generator includes at least: a drawing-up magnetic pole that generates a drawing-up magnetic force for attracting the developer in the developer supply conveyance path toward the developer carrier over an upper end of a side wall on a side of the developer carrier in the developer supply conveyance path and for drawing up the developer to the surface of the developer carrier; and a control magnetic pole that generates a control magnetic force for causing carrier chains in the developer that is passing through the control gap, the drawing-up magnetic pole and the control magnetic pole are adjacent to each other in the direction in which the surface of the developer carrier moves and have polarities opposite to each other, a prevention member is provided that secures, between the prevention member and the upper end of the side wall, a supply path through which the developer in the developer supply conveyance path passes toward the developer carrier at least over an entire area along the direction of the rotation axis of the developer carrier in the developing area and that prevents the developer, which is prevented by the developer control member from passing through the control gap, from moving toward the surface of the developer carrier along lines of the control magnetic force, and the peak of magnetic flux density of the drawing-up magnetic pole in the normal direction is disposed below the lower end of the supply path.

2. The developing device according to claim 1, wherein the developer supply conveyance member is a screw member and the drawing-up magnetic force of the drawing-up magnetic pole causes the developer in the developer supply conveyance path to be held by the side wall on the side of the developer carrier and below the supply path in the developer supply conveyance path.

3. An image forming apparatus according to claim 1, the image forming apparatus comprising:

a latent image carrier;

a latent image former that forms a latent image on the latent image carrier; and a developing device according to claim 1 that develops the latent image on the latent image carrier with a developer that contains toner and carriers, and the image forming apparatus forming an image on a recording material by transferring a toner image, which is formed by the developing device on the latent image carrier, onto the recording material.

4. A process cartridge according to claim 1, the process cartridge that holds at least a latent image carrier and a developing device according to claim 1 integrally and that can be attached to and detached from an image forming apparatus.

5. The developing device according to claim 1, wherein the developer control member includes a blade, and the prevention member includes a wall.

6. A developing device comprising:

a developer carrier that includes a magnetic field generator housed in the developer carrier, and that rotates, with a developer containing toner and magnetic carriers and carried on a surface of the developer carrier with a magnetic force that is generated by the magnetic field generator, so as to convey the developer to a developing area where the developer is opposed to the surface of a latent image carrier;

a developer control member that forms, between the developer control member and the surface of the developer carrier, a control gap through which the developer carried on the surface of the developer carrier passes and accordingly the amount of the developer to be conveyed to the developing area is controlled; and a developer supply conveyance path that is disposed adjacent to the surface of the developer carrier, in which the developer to be supplied onto the surface of the developer carrier is conveyed with a developer supply conveyance member along a direction of a rotation axis of the developer carrier, and into which the developer that is prevented by the developer control member from passing through the control gap is collected, wherein the magnetic field generator includes at least: a drawing-up magnetic pole that generates a drawing-up magnetic force for attracting the developer in the developer supply conveyance path toward the developer carrier over an upper end of a side wall on a side of the developer carrier in the developer supply conveyance path and for drawing up the developer to the surface of the developer carrier; and a control magnetic pole that generates a control magnetic force for causing carrier chains in the developer that is passing through the control gap, the drawing-up magnetic pole and the control magnetic pole are adjacent to each other in the direction in which the surface of the developer carrier moves and have polarities opposite to each other, a prevention member is provided that secures, between the prevention member and the upper end of the side wall, a supply path through which the developer in the developer supply conveyance path passes toward the developer carrier at least over an entire area along the direction of the rotation axis of the developer carrier in the developing area and that prevents the developer, which is prevented by the developer control member from passing through the control gap, from moving toward the surface of the developer carrier along lines of the control magnetic force, and a total magnetic flux density of the drawing-up magnetic pole in the normal direction in an area surrounded by a line connecting the center of rotation of the developer carrier and the lower end of the supply path and a tangent connecting the center of rotation of the developer carrier and the circumference of the developer supply conveyance member below the supply path on the surface of the developer carrier is equal to or larger than 700 mT·deg.

7. The developing device according to claim 6, wherein the developer supply conveyance member is a screw member and the drawing-up magnetic force of the drawing-up magnetic pole causes the developer in the developer supply conveyance path to be held by the side wall on the side of the developer carrier and below the supply path in the developer supply conveyance path.

8. An image forming apparatus according to claim 6, the image forming apparatus comprising:

a latent image carrier;

a latent image former that forms a latent image on the latent image carrier; and a developing device according to claim 5 that develops the latent image on the latent image carrier with a developer that contains toner and carriers, and the image forming apparatus forming an image on a recording material by transferring a toner image, which is formed by the developing device on the latent image carrier, onto the recording material.

9. A process cartridge according to claim 6, the process cartridge that holds at least a latent image carrier and a developing device according to claim 5 integrally, and that can be attached to and detached from an image forming apparatus.

10. The developing device according to claim 6, wherein the developer control member includes a blade, and the prevention member includes a wall.

11. A developing device comprising:

a developer carrier that carries and conveys a developer;

a development supply conveyance path that supplies the developer to the developer carrier;

a slit that is configured in a part of a side wall of the development supply conveyance path that is opposite to the developer carrier;

a first magnetic pole that is disposed such that a straight line connecting a peak of magnetic flux density of the first magnetic pole in the normal direction to a center of rotation of the developer carrier is positioned in an upstream side of a rotation direction of the developer carrier than a lower end of the slit; and a second magnetic pole that is disposed adjacent to the first magnetic pole in a downstream side of the rotation direction of the developer carrier, and that has polarities opposite to the first magnetic pole.

12. The developing device according to claim 11, wherein the slit extends along a direction of a rotation axis of the developer carrier.

13. The developing device according to claim 11, wherein the first magnetic pole is a drawing-up magnetic pole.

14. The developing device according to claim 11, wherein the slit is configured between an upper end of the development supply conveyance path and a prevention member.

15. A developing device comprising:

a developer carrier that carries and conveys a developer;

a development supply conveyance path that supplies the developer to the developer carrier; and a slit that is configured in a part of a side wall of the development supply conveyance path that is opposite to the developer carrier, wherein the developer carrier includes a first magnetic pole, and a second magnetic pole that is disposed adjacent to the first magnetic pole in a downstream side of a rotation direction of the developer carrier, the first magnetic pole and the second magnetic pole have polarities opposite to each other, and the slit is disposed between a straight line connecting a peak of magnetic flux density of the first magnetic pole in the normal direction to a center of rotation of the developer carrier and a straight line connecting a peak of magnetic flux density of the second magnetic pole in the normal direction to the center of rotation of the developer carrier, and the straight line connecting the peak of magnetic flux density of the first magnetic pole in the normal direction to the center of rotation of the developer carrier is positioned in an upstream side of a rotation direction of the developer carrier than a lower end of the slit.

16. The developing device according to claim 15, wherein the slit extends along a direction of a rotation axis of the developer carrier.

17. The developing device according to claim 15, wherein the first magnetic pole is a drawing-up magnetic pole.

18. The developing device according to claim 15, wherein the slit is configured between an upper end of the development supply conveyance path and a prevention member.

* * * * *